US008627525B2

(12) United States Patent
Jurmann

(10) Patent No.: US 8,627,525 B2
(45) Date of Patent: Jan. 14, 2014

(54) METHOD FOR THE CONTROL OF A SPINNING CYCLE OF A WASHING MACHINE AND A WASHING MACHINE SUITABLE FOR PERFORMING SAID METHOD

(75) Inventor: Rainer Jurmann, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1375 days.

(21) Appl. No.: 12/309,205

(22) PCT Filed: Jun. 20, 2007

(86) PCT No.: PCT/EP2007/056108

§ 371 (c)(1),
(2), (4) Date: Jan. 9, 2009

(87) PCT Pub. No.: WO2008/006675

PCT Pub. Date: Jan. 17, 2008

(65) Prior Publication Data

US 2009/0288260 A1 Nov. 26, 2009

(30) Foreign Application Priority Data

Jul. 12, 2006 (DE) ..... 10 2006 032 337

(51) Int. Cl.
*D06F 35/00* (2006.01)

(52) U.S. Cl.
USPC ..... 8/158; 68/3 R

(58) Field of Classification Search
USPC ..... 68/3 R
See application file for complete search history.

(56) References Cited

U.S. PATENT DOCUMENTS

| | | | | |
|---|---|---|---|---|
| 4,513,464 | A * | 4/1985 | Rettich et al. | 8/159 |
| 6,640,372 | B2 * | 11/2003 | Ciancimino et al. | 8/159 |
| 6,775,870 | B2 * | 8/2004 | Gayme et al. | 8/159 |
| 2001/0054204 | A1 * | 12/2001 | Ciancimino et al. | 8/159 |
| 2003/0101519 | A1 * | 6/2003 | Gayme et al. | 8/159 |
| 2003/0217901 | A1 * | 11/2003 | Carlson | 188/267 |
| 2004/0168480 | A1 * | 9/2004 | Lorenz et al. | 68/12.06 |
| 2005/0039859 | A1 | 2/2005 | Sugaya et al. | |
| 2005/0108830 | A1 | 5/2005 | Park et al. | |

FOREIGN PATENT DOCUMENTS

| | | | |
|---|---|---|---|
| DE | 2204325 | | 8/1973 |
| DE | 3342376 | A1 | 6/1984 |
| DE | 10202252 | C1 | 3/2003 |
| DE | 60013791 | T2 | 9/2005 |
| EP | 1275765 | A1 | 1/2003 |
| EP | 1607729 | A1 | 12/2005 |
| JP | 2005-198763 | A | 7/2005 |

* cited by examiner

*Primary Examiner* — Jason Ko
(74) *Attorney, Agent, or Firm* — James E. Howard; Andre Pallapies

(57) ABSTRACT

A method for controlling a spinning cycle of a washing machine, the method includes accelerating a drum up to a first speed at which the laundry items essentially lie firmly against the wall of the drum, detecting a movement of the detergent solution tub in at least one direction for at least one predetermined period during the rotation of the drum at a speed that is equal to or greater than the first speed, determining an amplitude of the movement for the recorded direction, determining further movement amplitudes for known or detected speeds during the predetermined period, determining a change in the movement amplitude over the speed, and controlling the spinning cycle as a function of the change of the movement amplitude.

26 Claims, 2 Drawing Sheets

METHOD FOR THE CONTROL OF A SPINNING CYCLE OF A WASHING MACHINE AND A WASHING MACHINE SUITABLE FOR PERFORMING SAID METHOD

BACKGROUND OF THE INVENTION

A method for compensating for imbalances in a washing machine is disclosed in DE 33 42 376 A1. In such a method a drum rotatably supported in the washing machine is accelerated up to a first speed, at which the items of laundry located in the drum lie against the drum wall, an imbalance is measured during the rotation of the drum at a speed which is equal to or greater than the first speed, and the speed is controlled as a function of the change in the imbalance.

A method for control of a spinning cycle and a washing machine with a detergent solution tub on sprung suspension in a housing, in which a drum is supported so that it can rotate around a horizontal axis are known from DE 22 04 325 A1. The washing machine has a device for detecting the detergent solution tub movement which is caused by an uneven distribution of the items of laundry in the drum, i.e. an imbalance of the laundry. To detect the movement the washing machine has an electromechanical converter which is arranged between the housing and the detergent solution tub and can detect the displacement of the detergent solution tub in relation to the housing in one direction. The known washing machine features a control device which can act on a drive of the washing machine, so that in the event of a highly uneven distribution the spin speed can be reduced or the spin process can even be aborted. During a spin duration a voltage proportional to the amplitude of the detergent solution tub movement is detected by the electromechanical converter. The detergent solution tub movements caused by a laundry imbalance occur especially as from a speed of the drum at which the items of laundry essentially lie firmly against the wall of the drum.

The movements caused by imbalances and thereby the forces acting on the components of the washing machine can be restricted with the measures demonstrated in DE 22 04 325 A1. The disadvantage of the known method is that only the movement occurring at the particular time can be detected. A prediction about the movements occurring during the ongoing spinning cycle, especially a prediction of the movement when the drum passes through a resonance of the oscillating detergent solution tub is only possible to a limited extent. Thus the spinning cycle cannot be influenced early enough to allow these types of large movements to be avoided which can cause the drum to strike the detergent solution tub or can cause the machine to move around.

BRIEF SUMMARY OF THE INVENTION

The object of the invention is thus to create a method and a washing machine with which a reliable spinning operation avoiding movement of the washing machine caused by an imbalance or damage to the washing machine caused by the drum striking the detergent solution tub is made possible.

This object is achieved by a method which has the features in accordance with claim 1 and by a washing machine with the features in accordance with claim 14. Advantageous embodiments of the invention are set down in the subclaims.

The inventive method for control of a spinning cycle is advantageously used for a washing machine which features a detergent solution tub on a sprung support within a housing with a drum supported around an essentially horizontal axis therein so that it can rotate, a variable speed-controlled drive driving the drum, a device for detecting a movement of the detergent solution tub caused by items of laundry distributed unevenly in the drum, and which has a program controller controlling the spinning cycle. The method comprises the steps in which the drum is accelerated to a first speed at which the items of laundry are essentially lying firmly against the wall of the drum, a movement of the detergent solution tub is detected in at least one direction for at least one predetermined period during the rotation of the drum at a speed which is equal to or greater than the first speed and an amplitude of the movement for a speed, also referred to below as movement amplitude, is defined or determined for the detected direction. The method is characterized by speeds detected or known from the predetermined period and movement amplitudes determined being determined by the change in the movement amplitude over the speed and the further spinning cycle being able to be controlled as a function of the change in the movement amplitude. The speed during a detection of the movement can be especially favorably determined from the control variables required for the speed control, for example a detected instantaneous speed or a known setpoint speed of the drive or the drum.

In the inventive method it is especially advantageous that it can be predicted from the change in the movement amplitude whether the amplitude of the movement of the detergent solution tub will increase with a further increase in speed and by what amount the movement amplitude increases for an increased speed. This enables the detergent solution tub movements to be reliably kept within permissible limits, since even before the movement amplitude that is still permissible has been reached, a disproportionate movement of the detergent solution tub can be counteracted by influencing the spinning cycle. In particular the detergent solution tub can be prevented from striking components of the washing machine during an acceleration of the drum through a critical speed range in which the maximum movement can occur. A shifting of the washing machine or damage to said machine as a result of the collisions can be reliably suppressed. A critical speed range is a range in which the drum is operated at a speed at which the frequency of rotation lies close to a resonant frequency of the oscillating detergent solution tub.

Preferably the movements are detected in a direction in which the greatest detergent solution tub movements are to be expected.

The change of the movement amplitude over the speed is determined in accordance with one possible embodiment by the movement amplitudes being determined for different speeds and stored in a first step, with the change of the movement amplitude over the speed then being determined in a second step by means of the stored values by the rise in the movement amplitude being computed as a function of the speed.

Detergent solution tubs on sprung suspension, which together with components rigidly attached to them can be referred to as oscillating systems, exhibit an oscillation behavior depending for each possible direction of movement on the mechanical design of the washing machine. Usually such oscillating systems have six degrees of freedom of movement, three translational and three rotational degrees of freedom. Each degree of freedom exhibits a resonance specific for the degree of freedom, which causes an amplification of the movement of the oscillating system in which resonance is excited, meaning that the drum of the detergent solution container is turned at a speed which corresponds to the resonant frequency. Thus the maximum movements of the oscillating system occur in the resonance. The resonant frequency and the degree of amplification are dependent on the masses or on the inertias, the spring stiffnesses, the damping constants and the geometrical structure of the oscillating system.

In an advantageous embodiment of the method the movement of the detergent solution tub in different directions, especially in directions X, Y and Z lying perpendicular to each other, is detected. Thus the movements can be assessed separately for each direction. It is of advantage in such cases for the oscillation behavior for the detected degrees of freedom individually and the free space available in a directions for the movement of the detergent solution tub which is limited by the housing and by components built into the housing to be able to be taken into account.

The movements in the individual directions can preferably be merged into a resulting movement. The movement amplitude is then defined in relation to the resulting movement. Such an embodiment advantageously enables s single control parameter to be provided that simultaneously takes into account the influence of the movement of the detergent solution tub in different directions.

The oscillating movement of the detergent solution tub in a first approximation is a sine-wave oscillation, thus it is of advantage to select the predetermined period for detecting the movement such that the period is at least equal to or greater than a duration in which the drum can execute at least one half revolution. Thus at least one halfwave of the oscillating movement can be detected and the amplitude for the halfwave safely determined. An amplitude is understood to be the maximum width of a positive or negative halfwave of an oscillation within a predetermined period or a predetermined measurement interval. In the sense of the invention variables are thus also understood as amplitudes that are essentially proportional to the amplitude. Such variables are for example a width between a maximum and a minimal value (peak-to-peak) of the oscillation, an effective value of the oscillation or an average amplitude of the oscillation within a measurement interval.

In a further preferred embodiment of the invention the changes of the movement amplitude over the speed are determined from at least two consecutive detections of the movement. The change in such an embodiment can be formed especially simply, for example by forming the difference of the values of two consecutive detections, with the cycle of a detection able to be executed in the same way in each case. The required storage means in such an embodiment are fewer than for a possible alternate embodiment, in which in a first step for a certain speed range the amplitudes and speeds are determined and in a second step by means of the stored values the changes in the movement amplitude over the speed are determined.

The change in the movement amplitude over the speed can be formed especially simply from a difference quotient, i.e. the quotient from the difference of two movement amplitudes and the difference between the speeds assigned to the movement amplitudes is computed. In an alternate embodiment there can also be provision for only the changes of the movement amplitude, i.e. the difference between two movement amplitudes of different speeds, to be taken into account. Such an embodiment is possible if the changes of the movement amplitude are always determined for the same speed difference. There can also be provision for the first derivation of the movement amplitude depending on the function of the speed to be computed. To this end, even in a first step, an approximation function of the movement amplitude over the speed of which the first derivation is known can be determined or is easily able to be determined. Such an approximation function can for example be a polynomial.

The influencing of the spinning cycle can be implemented especially simply in accordance with a further embodiment, in accordance with which the change of the movement amplitude over the speed is compared with a predetermined limit value of the change of the movement amplitude. A simple comparison between the change of the movement amplitude and the limit value can generate a corresponding control signal if the limit value is exceeded. In such cases it is especially advantageous for such an exceeded value to be established for a speed which is less than the resonance speed because the maximum of the change in the movement amplitude over the speed occurs at a speed which is lower than the speed at the resonance of the detergent solution tub. In addition the amount of the change in the movement amplitude is also dependent on the movement amplitude, so that the size of the laundry imbalance can be determined from the size of the change of movement. Thus the movement can be assessed approximately, but still reliably before the resonance is reached solely through observation of the cycle of the change in movement amplitude over the speed, i.e. even before reaching the maximum movement of the detergent solution tub. Preferably the limit value is predetermined such that a value which is below the limit value shows that the speed can be further increased, since with a further increase in speed, especially in a rotation of the drum in the resonant range of with an acceleration of the drum through the resonant range, the movements of the detergent solution tub remain sufficiently small and will not increase beyond permitted limits.

A movement amplitude of the detergent solution tub to be expected during the spinning cycle can be extrapolated for a next possible drum speed from the currently defined cycle of the determined movement amplitude over the speed. Many methods are known for such an extrapolation, for example the trend of the instantaneous change of the movement amplitude can be continued. The extrapolated movement amplitude can be compared with a predetermined limit value. In accordance with an alternate embodiment of the invention such a comparison can also be executed with the same effect by the limit value for the changes in the movement amplitude being determined as a function of the detected speed and/or the detected movement amplitude. No extrapolation has to be performed in such an embodiment, but it is sufficient to make a simple comparison of the changes of the movement amplitude with a limit value depending on the detected speed and/or the detected movement amplitude. The comparison can be undertaken early on at any speed.

The degree of an instantaneous change in the movement amplitude can be included as a measure for an instantaneous movement amplitude. In such a case it is sufficient to only embody the limit value for the change of the movement amplitude as a function of the speed. The preference is to take account of the movement amplitude already determined in any event. The limit value for the change in the movement amplitude can also exclusively depend on the instantaneous movement amplitude, in this case the limit value is checked at a fixed predetermined speed. The instantaneous movement amplitude can also be determined on the basis of a detected laundry imbalance. Thus for example an evaluation of the non-uniformity of the drum speed caused by the laundry load being distributed unevenly in the drum can be included for determining the laundry imbalance. A laundry imbalance determined in this manner is proportional to a movement amplitude of the detergent solution tub aligned perpendicular to the drum axis. Thus in the embodiment the limit value for the change in the movement amplitude can also be embodied as a function of the laundry imbalance.

Preferably in a further embodiment, if the limit value is exceeded for the extrapolated movement amplitude or the limit value is exceeded for the change in the movement amplitude the drum speed is reduced, especially the spinning cycle is aborted, i.e. the drum is brought to a halt. This ensures that the movements occurring through a further increase in the speed increase too greatly. Such a speed reduction or aborted spinning cycle is followed by a new spinning cycle, in which the laundry is redistributed during a first acceleration phase and the further spinning cycle is controlled in accordance with the inventive method. It is particularly useful that the prediction of a movement amplitude which is too great enables a spinning cycle to be aborted at an early stage. A disproportionate increase in the spinning of the laundry with a large imbalance is thus avoided.

In accordance with a further embodiment a spring rate c and/or a damping value k of the support of the detergent solution tub is varied actively by a control element of the washing machine if the limit value for the extrapolated movement amplitude or the limit value for the change in the movement amplitude is exceeded. By explicitly changing the spring rate c and/or of the damping value k of the support of the detergent solution tub, especially of a controllable damper, the resonant frequency of the oscillating system and thus the oscillation behavior can be controlled. It is thus possible to influence the movement of the oscillating system in such a way that, at the further speeds of a current spinning cycle, significantly reduced movement amplitudes of the oscillating system occur. Such control elements for changing a spring rate c and/or of a damping value k of the support of the detergent solution tub are preferably detected by the washing machine.

Preferably a number of limit values of the changes of the movement amplitude or of the extrapolated movement amplitude are provided, with the control measure to be initiated depending on which limit value is exceeded.

Thus, in a further embodiment of the invention there can be provision, if one of the limit values of the change in the movement amplitude or the movement amplitude of a maximum drum speed is exceeded, for a rotation acceleration rate of the drum and/or a current drive moment to be varied. With such a method step a force acting on the detergent solution tub can advantageously be generated by a variation of the rate of acceleration and/or of the drive moment, so that in the further spinning cycle the movement amplitudes of the detergent solution tub are reduced.

Exceeding a limit value can however also demonstrate that the movement amplitudes still remain sufficiently low, despite a relatively high laundry imbalance if a resonance is passed through quickly. This means that when the limit value is exceeded a large speed acceleration rate and preferably a reduced maximum drum speed are fixed. Preferably in such an embodiment a maximum limit value is monitored which must not be exceeded in any event.

The movement of the detergent solution tub is preferably detected with at least one sensor, especially with a position, movement or acceleration sensor, which can detect the change in position of the detergent solution tub in one and/or more directions. Such sensors can be easily arranged in the washing machine. Preferably they are accommodated in the detergent solution tub. The important factor here is that the sensors are able to detect a movement of the detergent solution tub which means a change in the position of the detergent solution tub in relation to the housing of the washing machine or a displacement and/or twisting of the detergent solution tub in relation to the housing. The values detected by the sensors can be computed by corresponding devices of the washing machine into a change of path and/or angle.

To execute the method a washing machine with a detergent solution tub on a sprung support within a housing is provided, in which a drum is essentially supported rotatably around a horizontal axis, with the washing machine having a variable speed-controlled drive which drives the drum, a device for detecting a detergent solution tub movement caused by an imbalance in the distribution of items of laundry in the drum, a speed detection device and a program control, which controls the spinning cycle in respect of the drum speed and of a timing cycle, and inventively a device for determining the change in the movement amplitude of the detergent solution tub over the speed. The device for determining the change in the movement amplitude is linked to the program controller or is included in the program controller, with a connection then being embodied between a module of the device and a control module of the program controller.

BRIEF DESCRIPTION OF THE DRAWINGS

The invention is explained in greater detail below with reference to schematic drawings. The figures are as follows.

DETAILED DESCRIPTION OF EXEMPLARY EMBODIMENTS OF THE PRESENT INVENTION

Figure 3:
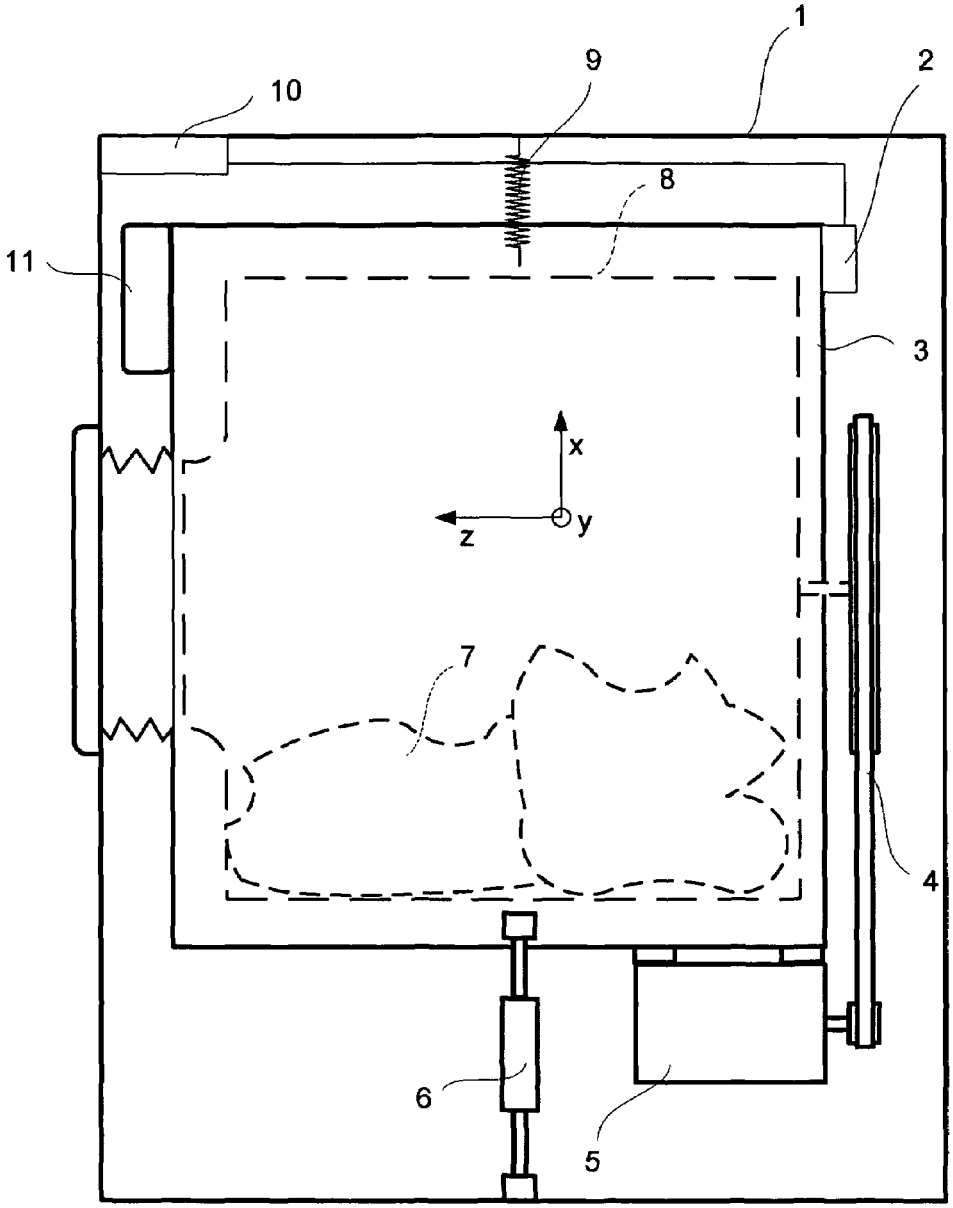
FIG. 3: a schematic diagram of a washing machine suitable for performing the method.

The washing machine shown in FIG. 3 has a housing 1 in which a detergent solution tub 3 is supported on springs. In an embodiment of the washing machine the detergent solution tub 3 is suspended on two springs 9 in the housing 1 and the detergent solution tub 3 is supported on two dampers 6 in the housing 1. The detergent solution tub 1 can oscillate in six degrees of freedom, three translational and three rotational degrees of freedom.

Arranged on the detergent solution tub 3 are further parts 2, 4, 5 and 11, especially balancing weights 11 and a drive 5, which is connected via a belt drive 4 to a drum 8 mounted rotatably in the detergent solution tub 3. The sprung assembly comprising the detergent solution tub 3 with all the parts mounted in and on it is also called the oscillating system. The drum 8 has an essentially horizontal axis of rotation.

The drive 5 is controlled by a speed-regulated controller which comprises a program controller 10. In alternate embodiments a speed-regulated controller linked to the program controller 10 can also be included the washing machine. The drive 5 features a tacho which detects the motor speed, which in accordance with the transmission ratio of the belt drive 4, corresponds to a drum speed n. Stored in the program controller 10 is a schedule for spinning cycles divided up into sections, which are executed sequentially depending on further control parameters by the program controller 10. This means that predetermined drum speed, acceleration rates for the drum and program section durations are stored in the program controller 10 which are forwarded at intervals to the control for the drive 5.

At the beginning of a spinning cycle the drum 8 is accelerated at a predetermined acceleration rate to a first speed, at which the items of laundry 7 to be spun lie in an essentially firm position on the drum wall precisely because of the centrifugal forces acting on the laundry items 7. During a first such acceleration of the drum 8 the items of laundry 7 are to be distributed more or less evenly over the surface of the drum. A degree of uneven distribution generally remains. The items of laundry 7 lying on the wall of the drum bring about an imbalance, depending on the unevenness of the distribution, which on rotation of the drum 8 excites the detergent solution tub 3 into an oscillating motion. The detergent solution tub 3 generally moves as a result of the imbalances in all six degrees of freedom, because the laundry distribution is mostly asymmetrical to the main axis of inertia of the oscillating system. In the said washing machine with a drum 8 rotatable about a horizontal axis the movements are mostly greatest perpendicular to the axis of rotation. To detect such a movement of the detergent solution tub 3 the washing machine has a position sensor 2 which can detect the position of the detergent solution tub 3 in relation to the housing 1 with reference to three axes X, Y and Z lying perpendicular to one another. By comparing two position measurements following on from each other in time the displacements of the detergent solution tub 3 are determined in the three axes X, Y and Z. Especially the amplitude A or the width of a full oscillation of the movement of the detergent solution tub 3 in a direction X or Y perpendicular to the axis of rotation of the drum can serve as a measure for the static imbalance of the laundry.

The movement of the detergent solution tub 3 is monitored during the rotation of the drum 8 as from the first speed. To this end, within a predetermined period for each of the three directions X, Y and Z, the maximum and minimal displacement of the detergent solution tub 3 and the speed of the drum 8 or of the motor 5 are detected. The difference between maximum and minimal displacement produces the average of double the amplitude A of the oscillation during the period, with the period being sufficient for the drum 8 to be able to execute a full rotation. A device for determining the amplitude A is included in the washing machine, especially in the program controller 10 or the position sensor 2. The displacements and the movement amplitude A are determined for different drum speeds n.

In an alternate embodiment the duration for detecting the displacements is only selected to be just long enough for the drum 8 to execute at least half a rotation during the period. In this embodiment the amplitude A is determined from the amount of the maximum or minimum displacement in relation to a zero point or an idle position of the detergent solution tub 3. Other methods for determining the amplitude can likewise be provided.

Figure 1:
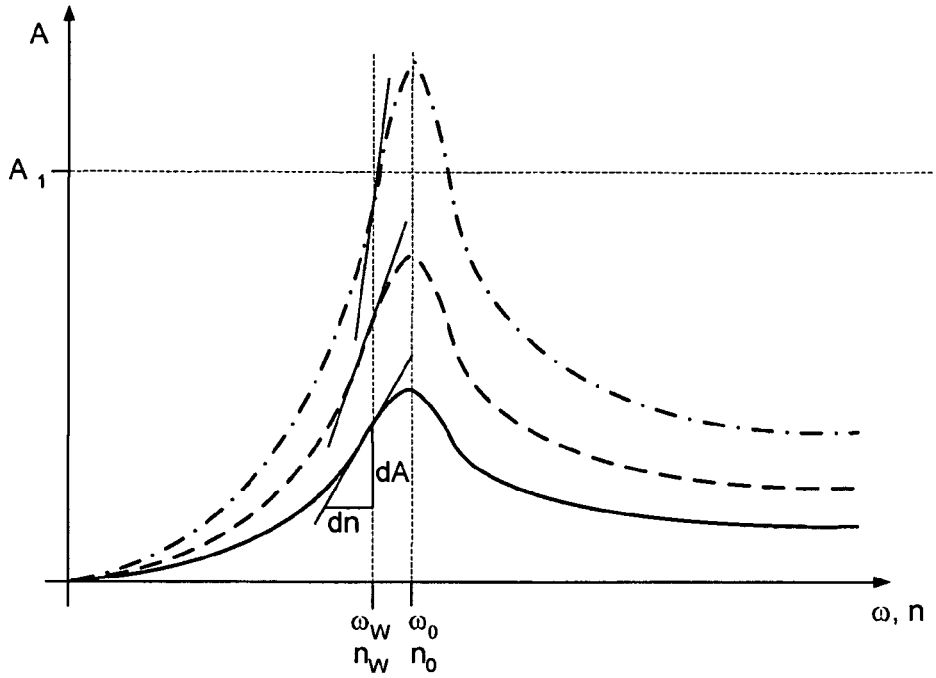
FIG. 1: typical curves of the movement amplitude in one direction over the speed of the drum of a washing machine for different laundry imbalances during a spinning cycle.

The invention uses the characteristics of an oscillation of an oscillating system excited from outside. In such an oscillation the function of the movement amplitude A over the speed n or the rotary frequency ω exhibits a maximum at a resonant speed $n_0$ or at a resonant frequency z $\omega_0$, with extremes of the first derivation of this function identifying the inflexion points of the function. An inflexion point of a function is a point of the function at which a left turn changes to a right turn or vice versa. The maximum of the first derivation identifies the first inflexion point of the function at a speed $n_w$ or at a frequency $\omega_w$ which is smaller than the resonant speed $n_0$. The said functional relationship between the movement amplitude A and the drum speed n is shown in FIG. 1 based on typical curves of the movement amplitude A of the detergent solution tub 3 in a direction over the drum speed n or the drum speed ω for a small laundry imbalance (solid line), for an average laundry imbalance (dashed line) and for a large laundry imbalance (dotted and dashed line). Each of the curves shown or each function exhibits a maximum at the resonant speed $n_0$ of the drum or at the rotary frequency $\omega_0$. The dashed horizontal line identifies a maximum permitted amplitude $A_1$, at which the detergent solution tub 3 can still oscillate freely. The movements of the detergent solution tub 3 are detected at a number of constant drum speeds n. In an alternate embodiment it is also possible to detect the movement during an increasing drum speed n. The curves shown in FIG. 1 can be slightly distorted depending on the accelerations of the drum selected during the detection of the movement, which means that depending on the acceleration rate, the maximum lies at a higher or lower speed in relation to the maxima shown in FIG. 1.

As shown in FIG. 1, for each curve of the movement amplitude A the rise dA/dn of the respective curve is depicted in a first inflexion point at the speed $n_w$. Such a rise is a change dA/dn of the movement amplitude A over the speed n. The rise dA/dn is at its greatest in the first inflexion point of each curve and increases as the laundry imbalance increases, whereby the changes dA/dn of the movement amplitude A over the speed n can also serve as a measure for the laundry imbalance.

Figure 2:
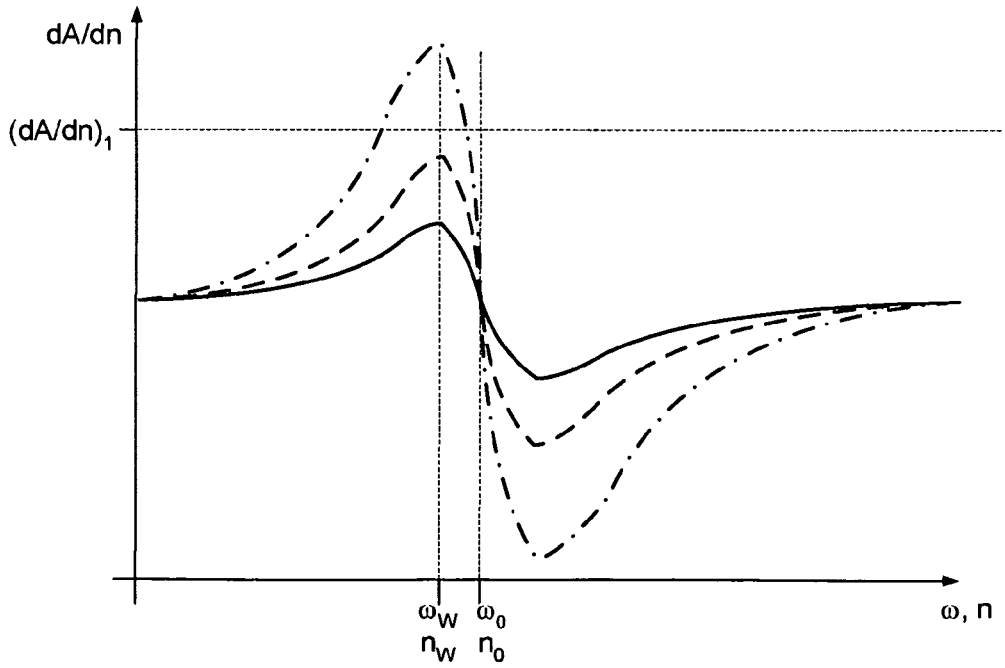
FIG. 2: typical curves of the change in movement amplitude in one direction over the speed of the drum for different laundry imbalances during a spinning cycle

FIG. 2 shows the slopes do/dA for the curves over speed n shown in FIG. 1 plotted in a diagram. In this case the curves are shown for a small (solid line), medium (dashed line and large (dotted and dashed line) laundry imbalance in the diagram. The rise dA/dn has a maximum at the speed $n_w$, which is smaller than the resonant speed $n_0$. The horizontal dashed line in the diagram of FIG. 2 identifies a limit value $(dA/dn)_1$ of the change in the movement amplitude A, whereby, in the example shown the limit value $(dA/dn)_1$ is only exceeded for a large laundry imbalance. The fact that the limit value $(dA/dn)_1$ has been exceeded is already established at a speed which is lower than the speed $n_w$ or than the speed $n_0$. This means that by monitoring the change dA/dn of the movement amplitude A possible exceeding of a movement amplitude is established at a time at which the movement amplitude A is still far lower than the limit value $A_1$. Thus large movement amplitudes A can be predicted even at an early stage by monitoring the rise dA/dn or the change dA/dn of the movement amplitude A.

After the first speed is reached at which the laundry essentially lies firmly against the wall of the drum, during of the further spinning cycle the speed n is increased step-by-step or continuously and during this process the change dA/dn is determined with a device of the washing machine. With the same device or a further device the change dA/dn is compared with the limit value $(dA/dn)_1$. If the limit value $(dA/dn)_1$ is exceeded the drum speed n is reduced until the laundry 7 can release itself from the laundry drum, and the steps given here are repeated. In an alternate embodiment the drum 8 is braked until it stops.

In a further embodiment a number of limit values $(dA/dn)_1$, $(dA/dn)_2$, etc. are stored in the program controller 10 of the washing machine. Different control measures are initiated depending on which limit value has been exceeded. Thus is also possible, after a limit value $(dA/dn)_1$ $(dA/dn)_2$, etc. has been exceeded, to continue the spinning cycle, with the parameters used for the continued spinning cycle, for example drive moment, acceleration rate and/or maximum speed, being selected depending on the exceeded limit value $(dA/dn)_1$, $(dA/dn)_2$, etc.

Above and beyond this, in alternate embodiments, because a limit value $(dA/dn)_1$ has been exceeded, the spring rate c of the springs 9 and/or the damping rate k of the dampers 6 of the detergent solution tub 3 can be actively varied by a control element of the washing machine not shown. The springs 9 and the dampers 6 form the support for the detergent solution tub 3.

The invention can not only be employed for washing machines with a horizontal axis of rotation of the drum but also for washing machines with a vertical or angled axis of rotation.

The invention claimed is:

1. A method for controlling a spinning cycle of a washing machine with a detergent solution tub spring-mounted in a housing in which a drum is supported so that it can rotate around a substantially horizontal axis, with a variable speed-regulated drive which drives the drum, with a device for detecting a speed of the drum, a device for detecting a movement of the detergent solution tub which is caused by items of laundry unevenly distributed in the drum, with a program controller, which controls the spinning cycle including the speed of the drum and its cycle over time, the method comprising:

accelerating the drum up to a first speed at which the laundry items essentially lie firmly against the wall of the drum;

detecting, with at least one sensor of the device for detecting, a movement of the detergent solution tub in at least one direction for at least one predetermined period during the rotation of the drum at a speed that is equal to or greater than the first speed;

detecting the speed of the drum and determining an amplitude of the movement for the recorded direction;

determining further movement amplitudes for known or detected speeds during the predetermined period;

determining a change in a ratio, the ratio being the movement amplitude over the speed of the drum; and controlling, with the program controller, a subsequent portion of the spinning cycle as a function of the change of the ratio.

2. The method of claim 1, wherein said detecting a movement comprises detecting a movement of the detergent solution tub in directions lying perpendicular to one another.

3. The method of claim 2, further comprising determining a resulting movement and a movement amplitude from the detected movements.

4. The method of claim 1, wherein the at least one predetermined period for detecting the movement amplitude is equal to or greater than a period in which the drum can execute at least one half revolution.

5. The method of claim 1, wherein said determining a change in the movement amplitude comprises determining the change from two consecutive detections of the movement.

6. The method of claim 5, wherein said determining a change in the movement amplitude comprises determining the change over the speed from a difference quotient.

7. The method of claim 1, further comprising extrapolating a movement amplitude from the change of the ratio which is compared with a predetermined limit value of the movement amplitude.

8. The method of claim 1, further comprising comparing the change in the ratio with a predetermined limit value of the change in the ratio.

9. The method of claim 8, wherein the predetermined limit value of the change in the ratio is based on the speed and/or a detected laundry load imbalance.

10. The method of claim 7, further comprising reducing a current drum speed or aborting the spinning cycle if the predetermined limit value is exceeded.

11. The method of claim 7, further comprising varying a maximum drum speed, a rate of rotational acceleration of the drum and/or a drive moment if the predetermined limit value is exceeded.

12. The method of claim 7, further comprising varying a spring rate and/or a damping value of a support of the detergent solution tub by a control element of the washing machine if the predetermined limit value is exceeded.

13. A washing machine comprising:

a housing;

a spring-mounted detergent solution tub in the housing;

a drum supported in the detergent solution tub and able to be rotated around a substantially horizontal axis, the drum being configured to contain items of laundry to be processed by the washing machine;

a variable speed-controlled drive which drives the drum;

a device for detecting a speed of the drum;

a device for detecting a movement of the detergent solution tub caused by the items of laundry being distributed unevenly in the drum, with the device for detecting the detergent solution tub movement comprising at least one sensor which can detect the change in position of the detergent solution tub in one or more directions;

a program controller which controls a spinning cycle of the washing machine, including the speed of the drum and its cycle over time; and a device that determines a change in a ratio, the ratio being a movement amplitude of the detergent solution tub over the speed of the drum, the device for determining being connected to the program controller, wherein a subsequent portion of the spinning cycle is controlled by the program controller as a function of the change in the ratio.

14. The washing machine of claim 13, further comprising a control element for changing a spring rate and/or a damping value of a support of the detergent solution tub.

15. The washing machine of claim 14, wherein the control element is a controllable damper having adjustable damping.

16. The washing machine of claim 13, wherein the at least one sensor is a position sensor, a movement sensor, or an acceleration sensor.

17. The washing machine of claim 13, wherein the detecting for detecting a movement detects a movement of the detergent solution tub in directions lying perpendicular to one another.

18. The washing machine of claim 17, wherein the program controller or the device that determines a resulting movement and a movement amplitude from the detected movements.

19. The washing machine of claim 13, wherein a predetermined period for detecting the movement amplitude is equal to or greater than a period in which the drum can execute at least one half revolution.

20. The washing machine of claim 13, wherein the device that determines determines a change in the movement amplitude from two consecutive detections of the movement.

21. The washing machine of claim 20, wherein the program controller or the device that determines extrapolates a projected movement amplitude from the change of the ratio, and compares the projected movement amplitude with a predetermined limit value of the movement amplitude.

22. The washing machine of claim 13, wherein the program controller or the device that determines compares the change in the ratio with a predetermined limit value of the change in the ratio.

23. The washing machine of claim 22, wherein the predetermined limit value of the change in the ratio is based on the speed and/or a detected laundry load imbalance.

24. The washing machine of claim 21, wherein the program controller reduces a current drum speed or aborts the spinning cycle if the predetermined limit value is exceeded.

25. The washing machine of claim 21, wherein the program controller varies a maximum drum speed, a rate of rotational acceleration of the drum and/or a drive moment if the predetermined limit value is exceeded.

26. The washing machine of claim 14, wherein the device that determines determines a change in the movement amplitude from two consecutive detections of the movement, the program controller or the device that determines extrapolates a projected movement amplitude from the change of the movement amplitude, and compares the projected movement amplitude with a predetermined limit value of the movement amplitude, and the control element varies the spring rate and/or the damping value of the support of the detergent solution tub if the predetermined limit value is exceeded.

* * * * *

UNITED STATES PATENT AND TRADEMARK OFFICE

CERTIFICATE OF CORRECTION

PATENT NO. : 8,627,525 B2
APPLICATION NO. : 12/309205
DATED : January 14, 2014
INVENTOR(S) : Rainer Jurmann It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1376 days.

Signed and Sealed this
Twenty-second Day of September, 2015

Michelle K. Lee

Michelle K. Lee
*Director of the United States Patent and Trademark Office*